US010450838B2

(12) United States Patent
Berry

(10) Patent No.: US 10,450,838 B2
(45) Date of Patent: Oct. 22, 2019

(54) DIVERTER VALVE FOR PROGRESSING CAVITY PUMP

(71) Applicant: Baker Hughes Incorporated, Houston, TX (US)

(72) Inventor: Douglas Berry, Claremore, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 273 days.

(21) Appl. No.: 15/612,518

(22) Filed: Jun. 2, 2017

(65) Prior Publication Data

US 2018/0016871 A1 Jan. 18, 2018

Related U.S. Application Data

(60) Provisional application No. 62/362,337, filed on Jul. 14, 2016.

(51) Int. Cl.
*E21B 34/14* (2006.01)
*E21B 43/12* (2006.01)
(Continued)

(52) U.S. Cl.
CPC ..... *E21B 34/14* (2013.01); *E21B 34/08* (2013.01); *E21B 43/121* (2013.01);
(Continued)

(58) Field of Classification Search
CPC ..... E21B 34/14; E21B 43/126; E21B 34/08; E21B 34/06; F04C 14/06; F04C 13/008;
(Continued)

(56) References Cited

U.S. PATENT DOCUMENTS 5,655,780 A * 8/1997 Gambrill ..... B01F 7/16 277/549
6,289,990 B1 9/2001 Dillon et al.
(Continued)

FOREIGN PATENT DOCUMENTS

| | | | |
|---|---|---|---|
| AU | 2015101051 | A4 | 9/2015 |
| AU | 201600194 | A1 | 2/2016 |
| WO | 2013137954 | A2 | 9/2013 |

OTHER PUBLICATIONS

Caledyne Ltd., "Artificial Lift Equipment, PCP Valve—FACT-071," found at http://www.caledyne.com/uploads/files/FACT-071-Artificial-lift-equipment-Web.pdf.

*Primary Examiner* — Wei Wang
(74) *Attorney, Agent, or Firm* — Bracewell LLP; James E. Bradley

(57) ABSTRACT

A diverter valve housing is secured to an upper end of a pump. A shuttle in the diverter valve housing moves between an upper closed position and a lower open position. A floating ring has an exterior band that abuts an upper end of the shuttle to move the shuttle downward. The floating ring moves upward when the pump operates. A bushing abuts an upward facing shoulder in the floating ring and is adhered within the bushing by a layer of adhesive. The shuttle has upper and lower seals separated by upper and lower spacer rings. A stop ring between the spacer rings limits downward movement of the upper spacer ring and also limits upward movement of the lower spacer ring.

20 Claims, 3 Drawing Sheets

(51) Int. Cl.

| | |
|---|---|
| ***F04C 2/10*** | (2006.01) |
| ***F04C 15/06*** | (2006.01) |
| ***E21B 34/08*** | (2006.01) |
| ***F04C 2/107*** | (2006.01) |
| ***F04C 13/00*** | (2006.01) |
| ***F04C 14/06*** | (2006.01) |

(52) U.S. Cl.
CPC ..... *E21B 43/126* (2013.01); *F04C 2/10* (2013.01); *F04C 2/1071* (2013.01); *F04C 13/008* (2013.01); *F04C 14/06* (2013.01); *F04C 15/064* (2013.01); *F05C 2225/12* (2013.01)

(58) Field of Classification Search
CPC ..... F04C 2/1071; F04C 15/064; F04C 2/10; F05C 2225/12
See application file for complete search history.

(56) References Cited

U.S. PATENT DOCUMENTS

| | | | |
|---|---|---|---|
| 8,545,190 | B2 | 10/2013 | Osborne |
| 8,955,601 | B2 | 2/2015 | Osborne |
| 9,027,654 | B2 | 5/2015 | Osborne |
| 2002/0174988 | A1 | 11/2002 | Szarka |
| 2011/0259428 | A1 | 10/2011 | Osborne |
| 2011/0259438 | A1 | 10/2011 | Osborne |
| 2012/0199210 | A1 | 8/2012 | Osborne |
| 2013/0146798 | A1 | 1/2013 | Osborne |
| 2015/0184487 | A1 | 7/2015 | Osborne |
| 2015/0233207 | A1 | 8/2015 | Osborne |

* cited by examiner

DIVERTER VALVE FOR PROGRESSING CAVITY PUMP

CROSS-REFERENCE TO RELATED APPLICATION

This application claims priority to provisional application filed Jul. 14, 2016, Ser. No. 62/362,337.

FIELD OF INVENTION

The present disclosure relates to downhole pumping systems in well bore fluids. More specifically, the present disclosure relates to a diverter valve for a rod driven progressing cavity pump for diverting well fluid from the production tubing when the pump is shut off.

BACKGROUND

Production tubing shut valves have been used for a number of years to protect submersible well pumps from back flow. A typical submersible pump assembly includes a pumping section that is placed within a well and takes suction directly from the well. The pumping section is often a centrifugal or a progressive cavity pump, however linear pumps are also employed. The pump assembly is usually suspended on a string of tubing that extends into the cased well. The pump discharges well fluid up the tubing.

When the pump shuts down, fluid may flow back down through the tubing and the intake of the pump, possibly spinning the pump in reverse. The downward flow occurs until the level of fluid in the tubing equals the level in the tubing annulus surround the tubing. The downward flow through the pump may bring debris in the tubing back into the pump, causing damage on later restarting. In other cases, downward flow simply stops, allowing solids to settle out from the long vertical section of production tubing on top of or in the pump. The tubing string or the pump can pack off or plug after such shut down. If the tubing does not drain, the operator may then have to bail out the production fluid before pulling the pump and tubing. Bailing involves running a bailer on a wire line relatedly down into the tubing, taking time.

In a current design, the pump assembly has a diverter valve that drains the tubing above the pump when the pump shuts down. The diverter valve has a valve housing installed with the tubing string above the pump. The valve housing has an interior in communication with fluid in the string of tubing above the valve housing. The valve housing has a shunt port communicating the interior of the valve housing with an annulus surround the string of tubing. A valve shuttle is slidably received within the valve housing for movement between upper and lower positions. The valve shuttle blocks communication through the shunt port while in the upper position, and while in the lower position, opens the shunt port. A float, also called a floating ring, is located in the upper portion of the shuttle valve assembly, the upper portion being referred to herein as a flow tube. If the pump is a progressing cavity type, the floating ring slides up and down a connector or polished rod extending upward from the pump. The polished rod is connected to a string of rotatable drive rods extending down the production tubing. When there is no flow or reverse flow, the floating ring slides down the polished rod and sits on top of the valve shuttle, pushing it down and opening the shut ports to allow fluid to drain out of the production tubing.

When the pump is again started, fluid flow acts on the floating ring to slide it upward along the polished rod within the flow tube. The flow tube is typically two to ten feet long. The flow tube inner diameter is larger than the production tubing inner diameter and through-bore of the diverter valve. Under normal flow velocities, the floating ring will rise a few feet. The larger inner diameter flow tube typically lowers the velocity of the fluid and allows the floating ring to stop rising.

SUMMARY

A well pumping apparatus comprises a pump having a rotatable drive member. A diverter valve housing is secured to an upper end of the pump, the diverter valve housing having a sidewall containing at least one outlet port. A shuttle is reciprocally carried in the diverter valve housing. The shuttle has an upper closed position blocking flow through the outlet port and a lower open position allowing flow through the outlet port. A spring in the diverter valve housing urges the shuttle to the upper position. A flow tube is secured to and extends upward from the diverter valve housing. The flow tube has a longitudinal axis and an upper end adapted to be secured to a string of production tubing. A connector rod is secured to and extends upward from the drive member through the spring and shuttle. The connector rod has an upper end with a rod coupling for connecting to a string of drive rods to rotate the drive member. A floating ring has a bore that receives the connector rod. The floating ring has an exterior band that abuts an upper end of the shuttle to move the shuttle downward toward the open position while the pump is shut off. The floating ring is upwardly movable in the flow tube relative to the shuttle in response to well fluid flowing upward from the pump while the pump is operating, causing the spring to move the shuttle to the closed position. The floating ring has an upward facing shoulder at a lower end of the bore. A thermoplastic bushing abuts the upward facing shoulder and is adhered within the bore by a layer of adhesive.

In one embodiment, a retainer ring is secured in the bore in engagement with an upper end of the bushing. An annular groove may be formed in the bore at an upper end of the bushing. The retainer ring may comprise a snap ring in engagement with the groove and overlying the upper end of the bushing. The upward facing shoulder has an inner diameter that is larger than an inner diameter of the bushing in one embodiment. In the embodiment shown, the floating ring has a cylindrical portion extending upward from the band. The bushing has a wall thickness that is greater than one-half a wall thickness of the cylindrical portion. Also, in this embodiment, the bushing has a radial wall thickness that is at least 25% of a radius of the connector rod. More specifically, the bushing radial wall thickness may be at least 35% of the radius of the connector rod.

The shuttle comprises a tubular member having an exterior upper cylindrical portion and an exterior lower cylindrical portion of smaller outer diameter than the upper cylindrical portion and separated from the upper cylindrical portion by a downward facing shoulder. Annular upper and lower seals surround the lower cylindrical portion. At least one rigid spacer ring surrounds the lower cylindrical portion and axially separates the upper and lower seals from each other. A spacer ring retainer means releasably retains the spacer ring with the shuttle such that an upward force imposed on the lower seal will not transmit through the spacer ring to the upper seal.

In the embodiment shown, the spacer ring comprises rigid upper and lower spacer rings. The spacer ring retainer means may comprise an annular groove formed on the lower cylindrical portion at a lower end of the upper spacer ring and an upper end of the lower spacer ring. A resilient stop ring fits in the groove in abutment with the lower end of the upper spacer ring and the upper end of the lower spacer ring. In this embodiment, a threaded ring is secured by threads to an exterior threaded section on the shuttle below the lower cylindrical portion and the lower seal to retain the lower seal and the lower spacer ring on the lower cylindrical portion. The exterior threaded section has an outer diameter smaller than the outer diameter of the lower cylindrical portion.

Figure 1A:
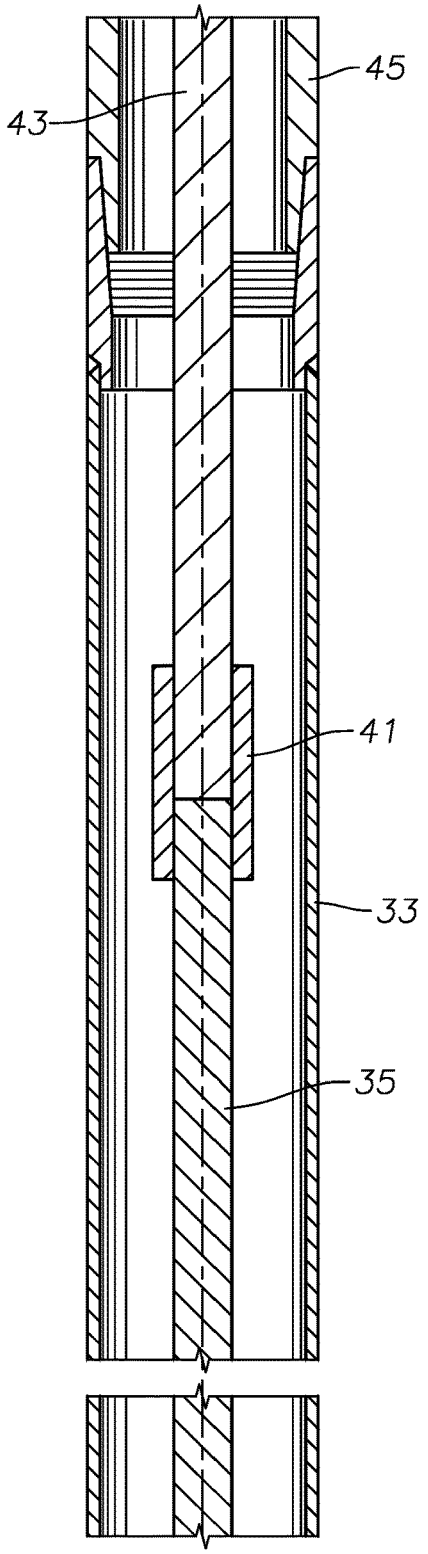
FIGS. 1A and 1B comprise a partial sectional view of progressing cavity pump system having a diverter valve in accordance with this disclosure and disposed in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1B:
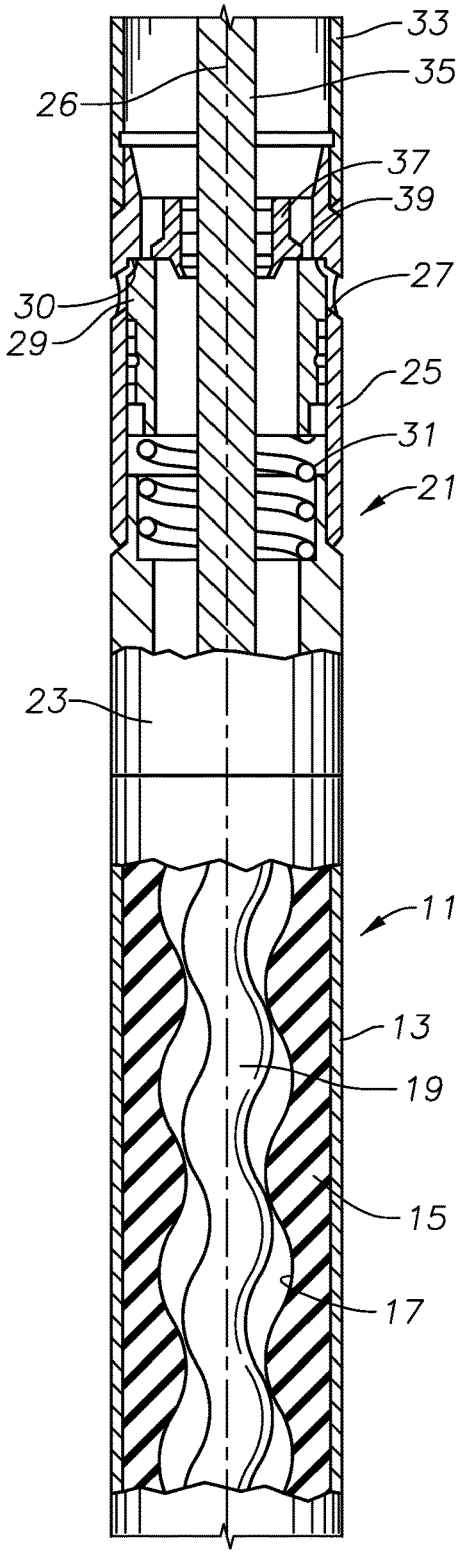

Referring to FIG. 1B, pump 11 may be of various types, and in this example, comprises a progressing cavity pump. Pump 11 has a tubular housing 13 containing an elastomeric stator 15. Stator 15 has a conventional cavity 17 with multiple helical lobes. A drive member or rotor 19 having a conventional helical lobed exterior fits within cavity 17. Rotating rotor 19 causes well fluid to flow upward in cavity 17.

A diverter valve 21 has a threaded connector 23 that secures to an upper end of pump housing 13. Diverter valve 21 has a tubular housing 25 with a longitudinal axis 26. Shunt or outlet ports 27 are located in the side wall of valve housing 25. Outlet ports 27 may incline downward and outward, as illustrated.

A shuttle 29 moves reciprocally within valve housing 25. Shuttle 29 has an upper closed position blocking outlet ports 27, which is the position shown in FIG. 1B. In the closed position, an upper end of shuttle 29 abuts a downward facing shoulder 30 in the bore of valve housing 25. Shuttle 29 has a lower position spaced below outlet ports 27 to open them. A coil spring 31 in valve housing 25 below shuttle 29 urges shuttle 29 to the upper position.

A flow tube 33 has a lower end that secures to the upper end of valve housing 25. A polished rod or connector rod 35 secures to the upper end of rotor 19 and extends upward through spring 31 and shuttle 29 into flow tube 33. The outer diameter of connector rod 35 is considerably smaller than the inner diameter of shuttle 29 and flow tube 33.

Connector rod 35 extends through a floating ring 37 that slides on connector rod 35 along axis 26. The opening in floating ring 37 through which connector rod 35 passes is slightly larger than the smooth outer diameter of connector rod 35, enabling floating ring 37 to slide upward and downward on connector rod 35. Friction may or may not cause floating ring 37 to spin some with connector rod 35 as it rotates.

Floating ring 37 has an external shoulder or band 39 that lands on the upper end of shuttle 29 while floating ring 37 is in a lower position. Band 39 is slightly greater in outer diameter than the inner diameter of shuttle 29, blocking downward flow of well fluid through shuttle 29 while in engagement with shuttle 29. The outer diameter of band 39 is considerably smaller than the inner diameter of flow tube 33.

Referring to FIG. 1A, a rod coupling 41 secures by threads to the upper end of connector rod 35. Rod coupling 41 connects connector rod 35 to the lower end of a string of drive rods 43 extending downward through a string of production tubing 45 that secures to the upper end of flow tube 33. A motor and gearbox (not shown) at an upper end of the well will rotate drive rods 43. Preferably, the upper end of rod connector 35 is located within flow tube 33 below production tubing 45.

Referring also to FIG. 1B, the cross sectional flow area through shuttle 29 is less than the cross-sectional flow area through flow tube 33. The cross-sectional flow area through flow tube 33 may be greater than the cross-sectional flow area through production tubing 45. The outer diameters of production tubing 45, flow tube 33, valve housing 25 and pump housing 13 may be the same. The length of flow tube 33 is preferably greater than 10 feet; it may be greater than 13 feet; it may also be longer than 15 feet. Stated another way, the length of flow tube 33 may be 25 to 30 times the outer diameter of valve housing 25.

During operation, the motor and gearbox (not shown) at the surface of the well rotate drive rods 43, which in turn rotate connector rod 35 and rotor 19. The engagement of rotor 19 with stator cavity 17 causes connector rod 35 and at least the lower portion of drive rods 43 to orbit, rather than remain on axis 26. Well fluid flows up from pump 11 through shuttle 29, lifting floating ring 37 from shuttle 29. The well flow flows around floating ring 37 up flow tube 33. Floating ring 37 will rise in flow tube 33 to a level that depends on the flow rate and the gas/liquid content of the well fluid. The maximum limit will occur when and if floating ring 37 contacts rod coupling 41. Spring 31 will keep shuttle 29 in the upper closed position, blocking any flow outward through outlet ports 27.

When the operator or control system stops rotating drive rods 43, floating ring 37 will move down flow tube 33 and land on shuttle 29. Floating ring band 39 forms a sealing engagement with the upper end of shuttle 29. The weight of the well fluid in production tubing 45 will cause floating ring 37 to push shuttle 29 downward, compressing spring 31. As shuttle 29 moves downward, outlet ports 27 open to allow well fluid in production tubing 45 and flow tube 33 to flow out outlet ports 27 to the annulus surrounding pump 11. After the well fluid in production tubing 45 and flow tube 33 drains to a level with the well fluid in the annulus surrounding pump 11, spring 31 will push shuttle 29 back up to the closed position.

Figure 2:
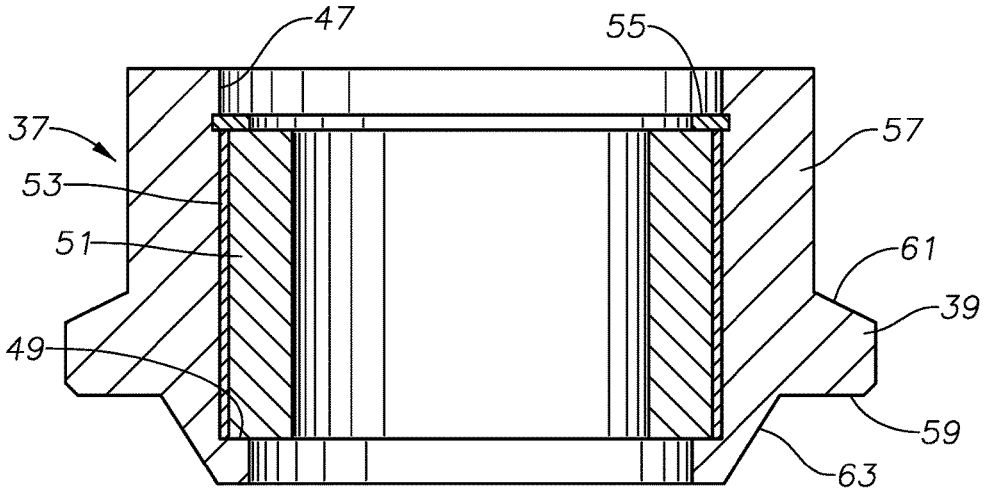
FIG. 2 is a sectional view of the floating ring of the diverter valve of FIG. 1B, shown removed from the valve.

Referring to FIG. 2, floating ring 37 is preferably a metallic member with a bore 47 concentric with axis 26. Bore 47 has an upward facing shoulder 49 that provides axial support for a thermoplastic bushing 51, which may be formed of polyether ether ketone (PEEK) or other materials. Bushing 51 is a cylindrical member with an outer diameter that fits closely in bore 47 and an inner diameter that closely receives connector rod 35 (FIG. 1B). Bushing is first fabricated, then glued inside bore 47 with a suitable adhesive layer 53 (shown exaggerated in thickness). Adhesive layer 53 prevents rotation and axial movement between bushing 51 and floating ring 37. Optionally, a retainer such as snap ring 55 fits within a groove in bore 47 and overlies the upper end of bushing 51. In addition to adhesive layer 53, shoulder 49 provides additional support to retain bushing 51 in floating ring 37 against a downward axial force. Snap ring 55 provides additional support to retain bushing 51 in floating ring 37 against an upward force.

Floating ring 37 has an exterior cylindrical portion 57 extending upward from band 39. Band 39 has a cylindrical exterior that is larger in outer diameter than cylindrical portion 57. In this example, band 39 has an upper side 61 that is conical and extends downward and outward from cylindrical portion 57. Band 39 may have a conical lower side 63 that extends upward and outward from the bottom of floating ring 37.

In this embodiment, bushing 51 has a radial wall thickness that is greater than one-half a wall thickness of floating ring 37 measured from bore 47 to the exterior of cylindrical portion 57. Also, preferably bushing 51 has a radial wall thickness that is at least 25% of a radius of connector rod 35 (FIG. 1B). More particularly, the radial wall thickness of bushing 51 is at least 35% of a radius of connector rod 35. The wall thickness of bushing 51 is greater than the radial width of upward facing shoulder 49. The inner diameter of bushing 51 is considerably smaller than the inner diameter of upward facing shoulder 49.

Figure 3:
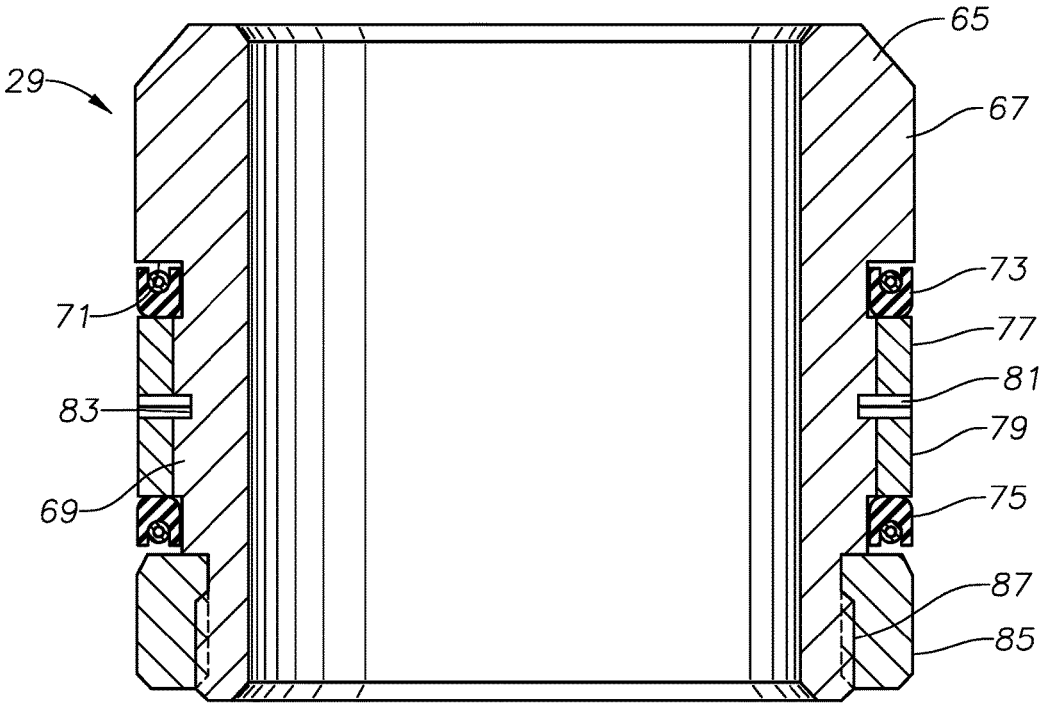
FIG. 3 is a sectional view of the shuttle of the valve of FIG. 1B, shown removed from the valve.

Referring to FIG. 3, shuttle 29 comprises a tubular metallic member 65 with an exterior that includes an upper cylindrical portion 67 and a lower cylindrical portion 69 of smaller diameter. A downward facing shoulder 71 defines a junction between upper cylindrical portion 67 and lower cylindrical portion 69. Annular upper and lower seals 73, 75 extend around lower cylindrical portion 69 for sealing engagement with the inner surface of valve housing 25 (FIG. 1B).

Figure 4:
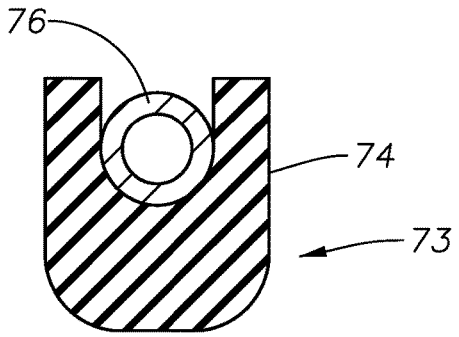
FIG. 4 is a transverse sectional view of one of the seals of the shuttle of FIG. 3.

Upper and lower seals 73, 75 may be of various types, and in this embodiment, each has an elastomeric portion that is generally U-shaped, having two legs 74, as illustrated in FIG. 4, defining an opening on either the upper side or the lower side. The opening of the elastomeric portion in upper seal 73 faces upward while the opening in the elastomeric portion of lower seal 75 faces downward. A metal biasing member or spring 76 that may have a circular transverse cross section fits within the legs 74 of the elastomeric portion to bias the legs apart from each other. The U-shape makes each seal 73, 75 pressure energized. Pressure from above enters the opening and forces legs 74 of upper seal 73 apart to sealingly engage lower cylindrical portion 69 and the inner surface of valve housing 25 (FIG. 1A). Pressure from below forces legs 74 of lower seal 75 apart to sealingly engage lower cylindrical portion 69 and the inner surface of valve housing 25.

Upper and lower spacer rings 77, 79 are located between upper and lower seals 73, 75 in this example. Each spacer ring 77, 79 is a rigid ring, such as a metal, that fits closely but slidingly around lower cylindrical portion 69. A retainer or stop ring 81 fits around lower cylindrical portion 69 between upper and lower spacer rings 77, 79. Stop ring 81 resiliently snaps into an annular groove 83 and protrudes outward from lower cylindrical portion 69 between the lower end of upper spacer ring 77 and the upper end of lower spacer ring 79. The lower end of upper spacer ring 77 abuts the upper side of stop ring 81, limiting the downward movement of upper spacer ring 77 on lower cylindrical portion 69. The upper end of lower spacer ring 79 abuts the lower side of stop ring 81, limiting the upward movement of lower spacer ring 79 on lower cylindrical portion 69.

A threaded retainer ring 85 secures to a threaded section 87 on tubular member 65 below lower seal 75. Threaded section 87 preferably has an outer diameter less than the outer diameter of lower cylindrical portion 69 so as to readily allow seals 73, 75, spacer rings 77, 79 and stop ring 81 to be installed and removed from tubular member 65.

Figure 5:
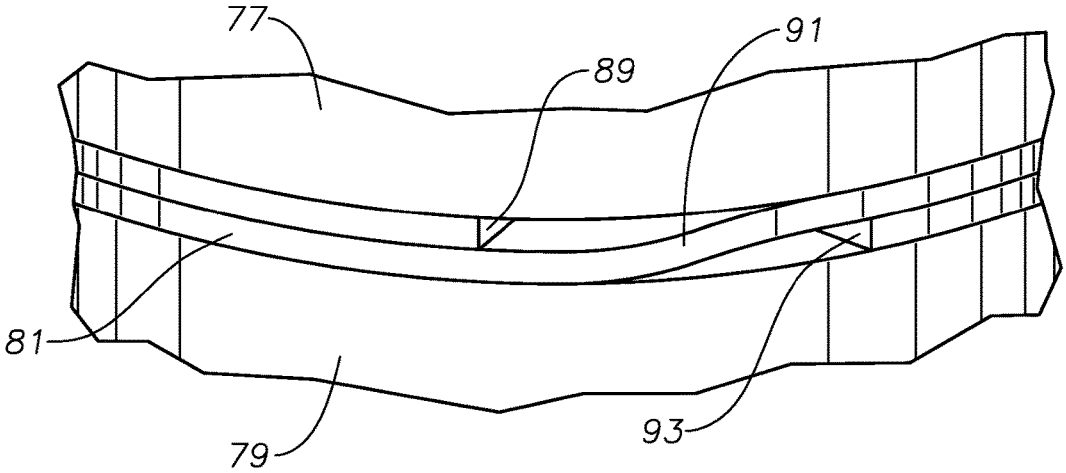
FIG. 5 is a partial perspective view of the shuttle of FIG. 3, illustrating part of a stop ring.

Stop ring 81 releasably secures to lower cylindrical portion 69 and may be of various types of rings. Referring to FIG. 5, in this example, stop ring 81 is a spiral ring that encircles groove 83 at least twice. Stop ring 81 extends from a first end 89 through a complete 360 degree turn 91 to a second end 93.

The axial dimension from the lower end of upper spacer ring 77 to the upper side of upper seal 73 may be less than the axial distance from stop ring 81 to downward facing shoulder 71. Upper spacer ring 77 and upper seal 73 are thus free to move axially a short distance relative to stop ring 81, tubular member 65 and each other. When pressure from above upper seal 73 occurs, upper seal 73 and upper spacer ring 77 may move downward slightly until stopped by stop ring 81. Similarly, the axial dimension from the upper end of lower spacer ring 79 to the lower side of lower seal 75 may be less than the axial distance from stop ring 81 to threaded retainer 85. Lower spacer ring 79 and lower seal 75 are thus free to move axially a short distance relative to stop ring 81, tubular member 65 and each other. When pressure from below lower seal 75 occurs, lower seal 75 and lower stop ring 79 may move upward slightly until stopped by stop ring 81. The sliding engagement of upper and lower seals 73, 75 with the inner surface of valve housing 25 (FIG. 1B) while shuttle 29 moves between the closed and open positions also can cause relative axial movement of seals 73, 75 and stop rings 77, 79.

Stop ring 81 and spacer rings 77, 79 prevent a downward force imposed on upper seal 73 from transmitting to lower seal 75. Similarly, stop ring 81 and spacer rings 77, 79 prevent an upward force imposed on lower seal 75 from transmitting to upper seal 73. Alternate spacer ring retainer means exist for releasably retaining spacer ring assembly 77, 79 with shuttle 29 such that an upward force imposed on lower seal 75 will not transmit through upper spacer ring 77 to the upper seal 73 and vice-versa. For example, a single spacer ring between seals 73, 75 that is releasably secured to lower cylindrical portion 69, such as by a pin or screw, is feasible.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A well pumping apparatus, comprising:

a pump having a rotatable drive member;

a diverter valve housing secured to an upper end of the pump, the diverter valve housing having a sidewall containing at least one outlet port;

a shuttle reciprocally carried in the diverter valve housing, the shuttle having an upper closed position blocking flow through the outlet port and a lower open position allowing flow through the outlet port;

a spring in the diverter valve housing that urges the shuttle to the upper position;

a flow tube secured to and extending upward from the diverter valve housing, the flow tube having a longitudinal axis and an upper end adapted to be secured to a string of production tubing;

a connector rod secured to and extending upward from the drive member through the spring and the shuttle, the connector rod having an upper end with a rod coupling for connecting to a string of drive rods to rotate the drive member;

a floating ring having a bore that receives the connector rod, the floating ring having an exterior band that abuts an upper end of the shuttle to move the shuttle downward toward the open position while the pump is shut off, the floating ring being upwardly movable in the flow tube relative to the shuttle in response to well fluid flowing upward from the pump while the pump is operating, causing the spring to move the shuttle to the closed position;

an upward facing shoulder at a lower end of the bore;

a thermoplastic bushing abutting the upward facing shoulder; and a layer of adhesive between the bushing and the bore that bonds the bushing to the floating ring.

2. The apparatus according to claim 1, further comprising a retainer ring secured in the bore in engagement with an upper end of the bushing.

3. The apparatus according to claim 1, further comprising:

an annular groove in the bore at an upper end of the bushing; and a snap ring in engagement with the groove and overlying the upper end of the bushing.

4. The apparatus according to claim 1, wherein the upward facing shoulder has an inner diameter that is larger than an inner diameter of the bushing.

5. The apparatus according to claim 1, wherein the bushing has a radial wall thickness that is at least 25% of a radius of the connector rod.

6. The apparatus according to claim 1, wherein the bushing has a radial wall thickness that is at least 35% of a radius of the connector rod.

7. The apparatus according to claim 1, wherein the shuttle comprises:

a tubular member having an exterior upper cylindrical portion and an exterior lower cylindrical portion of smaller outer diameter than the upper cylindrical portion and separated from the upper cylindrical portion by a downward facing shoulder;

annular upper and lower seals surrounding the lower cylindrical portion;

at least one rigid spacer ring surrounding the lower cylindrical portion and axially separating the upper and lower seals from each other; and spacer ring retainer means for releasably retaining the spacer ring with the shuttle such that an upward force imposed on the lower seal will not transmit through the spacer ring to the upper seal.

8. The apparatus according to claim 1, wherein the shuttle comprises:

a tubular member having an exterior upper cylindrical portion and an exterior lower cylindrical portion of smaller outer diameter than the upper cylindrical portion and separated from the upper cylindrical portion by a downward facing shoulder;

annular upper and lower seals surrounding the lower cylindrical portion;

rigid upper and lower spacer rings surrounding the lower cylindrical portion and axially separating the upper and lower seals from each other;

an annular groove on the lower cylindrical portion at a lower end of the upper spacer ring and an upper end of the lower spacer ring;

a stop ring that fits in the groove in abutment with the lower end of the upper spacer ring and the upper end of the lower spacer ring, preventing an upward force imposed on the lower spacer ring from transferring to the upper spacer ring.

9. The apparatus according to claim 8, further comprising:

a threaded ring secured by threads to an exterior threaded section on the shuttle below the lower cylindrical portion and the lower seal to retain the lower seal and the lower spacer ring on the lower cylindrical portion; and wherein the exterior threaded section has an outer diameter smaller than the outer diameter of the lower cylindrical portion.

10. A well pumping apparatus, comprising:

a pump having a rotatable drive member;

a diverter valve housing secured to an upper end of the pump, the diverter valve housing having a sidewall containing at least one outlet port;

a shuttle reciprocally carried in the diverter valve housing, the shuttle having an upper closed position blocking flow through the outlet port and a lower open position allowing flow through the outlet port;

a spring in the diverter valve housing that urges the shuttle to the upper position;

a flow tube secured to and extending upward from the diverter valve housing, the flow tube having a longitudinal axis and an upper end adapted to be secured to a string of production tubing;

a connector rod secured to and extending upward from the drive member through the spring and the shuttle, the connector rod having an upper end with a rod coupling for connecting to a string of drive rods to rotate the drive member;

a floating ring having a bore that receives the connector rod, the floating ring having an exterior band that abuts an upper end of the shuttle to move the shuttle downward toward the open position while the pump is shut off, the floating ring being upwardly movable in the flow tube relative to the shuttle in response to well fluid flowing upward from the pump while the pump is operating, causing the spring to move the shuttle to the closed position;

an upward facing shoulder at a lower end of the bore;

a thermoplastic bushing abutting the upward facing shoulder and adhered within the bore by a layer of adhesive; wherein the floating ring has a cylindrical portion extending upward from the band; and the bushing has a wall thickness that is greater than one-half a wall thickness of the cylindrical portion.

11. A well pumping apparatus, comprising:

a pump having a rotatable drive member;

a diverter valve housing secured to an upper end of the pump, the diverter valve housing having a sidewall containing at least one outlet port;

a shuttle reciprocally carried in the diverter valve housing, the shuttle having an upper closed position blocking flow through the outlet port and a lower open position allowing flow through the outlet port;

a spring in the diverter valve housing that urges the shuttle to the closed position;

a flow tube secured to and extending upward from the diverter valve housing, the flow tube having a longitudinal axis and an upper end adapted to be secured to a string of production tubing;

a connector rod secured to and extending upward from the drive member through the spring and the shuttle, the connector rod having an upper end with a rod coupling for connection to a string of drive rods to rotate the drive member;

a floating ring having a bore that receives the connector rod, the floating ring having an exterior band with a lower side that abuts an upper end of the shuttle to move the shuttle downward toward the open position while the pump is shut off, the floating ring being upwardly movable in the flow tube relative to the shuttle in response to well fluid flowing upward from the pump while the pump is operating, causing the spring to move the shuttle to the closed position; wherein the shuttle comprises:

a tubular member having an exterior upper cylindrical portion and a downward facing shoulder at a lower end of the upper cylindrical portion;

an annular upper seal in abutment with the downward facing shoulder;

a lower cylindrical portion of smaller outer diameter than the upper cylindrical portion extending downward from the upper seal, the lower cylindrical portion having a smooth exterior surface to facilitate sliding the upper seal up over the lower cylindrical portion to the downward facing shoulder during assembly;

an annular lower seal at a lower end of the lower cylindrical portion;

at least one rigid spacer ring surrounding the lower cylindrical portion and axially separating the upper and lower seals from each other;

a recess in the lower cylindrical portion;

a stop member separable from the spacer ring that inserts into engagement with the recess and the spacer ring for releasably retaining the spacer ring with the shuttle such that an upward force imposed on the lower seal will not transmit through the spacer ring to the upper seal.

12. The apparatus according to claim 11, further comprising:

a threaded ring secured by threads to an exterior threaded section on the shuttle below the lower cylindrical portion and the lower seal to retain the lower seal on the lower cylindrical portion.

13. The apparatus according to claim 11, wherein:

the upper seal has an elastomeric portion with an upward facing U-shape in transverse cross section; and the lower seal has an elastomeric portion with a downward facing U-shape in transverse cross section.

14. A well pumping apparatus, comprising:

a pump having a rotatable drive member;

a diverter valve housing secured to an upper end of the pump, the diverter valve housing having a sidewall containing at least one outlet port;

a shuttle reciprocally carried in the diverter valve housing, the shuttle having an upper closed position blocking flow through the outlet port and a lower open position allowing flow through the outlet port;

a spring in the diverter valve housing that urges the shuttle to the closed position;

a flow tube secured to and extending upward from the diverter valve housing, the flow tube having a longitudinal axis and an upper end adapted to be secured to a string of production tubing;

a connector rod secured to and extending upward from the drive member through the spring and the shuttle, the connector rod having an upper end with a rod coupling for connection to a string of drive rods to rotate the drive member;

a floating ring having a bore that receives the connector rod, the floating ring having an exterior band with a lower side that abuts an upper end of the shuttle to move the shuttle downward toward the open position while the pump is shut off, the floating ring being upwardly movable in the flow tube relative to the shuttle in response to well fluid flowing upward from the pump while the pump is operating, causing the spring to move the shuttle to the closed position; wherein the shuttle comprises:

a tubular member having an exterior upper cylindrical portion and an exterior lower cylindrical portion of smaller outer diameter than the upper cylindrical portion and separated from the upper cylindrical portion by a downward facing shoulder;

annular upper and lower seals surrounding the lower cylindrical portion;

at least one rigid spacer ring surrounding the lower cylindrical portion and axially separating the upper and lower seals from each other;

spacer ring retainer means for releasably retaining the spacer ring with the shuttle such that an upward force imposed on the lower seal will not transmit through the spacer ring to the upper seal; wherein the at least one rigid spacer ring comprises an upper spacer ring surrounding the lower cylindrical portion below the upper seal and a lower spacer ring surrounding the lower cylindrical portion above the lower seal, the upper and lower spacer rings being axially movable a limited extent relative to the lower cylindrical portion and relative to each other; the spacer ring retainer means comprises:

a stop ring in releasable engagement with a groove on the lower cylindrical portion below the upper spacer ring and above the lower spacer ring; wherein downward movement of the upper spacer ring on the lower cylindrical portion is limited by contact with the stop ring; and upward movement of the lower spacer ring on the lower cylindrical portion is limited by contact with the stop ring.

15. The apparatus according to claim 14, wherein the stop member comprises a spiral ring.

16. A well pumping apparatus, comprising:

a diverter valve housing adapted to be secured to an upper end of a pump, the diverter valve housing having a sidewall containing at least one outlet port;

a shuttle reciprocally carried in the diverter valve housing, the shuttle having an upper closed position blocking flow through the outlet port and a lower open position allowing flow through the outlet port;

a spring in the diverter valve housing that urges the shuttle to the closed position;

a flow tube secured to and extending upward from the diverter valve housing, the flow tube having a longitudinal axis and an upper end adapted to be secured to a string of production tubing;

a connector rod extending through the spring and the shuttle, the connector rod having a lower end for connection to a rotatable drive member of the pump, the connector rod having an upper end within the flow tube with a rod coupling for connecting to a string of drive rods to rotate the drive member;

a floating ring having a bore that receives the connector rod, the floating ring having an exterior band that abuts an upper end of the shuttle to move the shuttle downward toward the open position in response to well fluid flowing downward in the production tubing while the pump is shut off, the floating ring being upwardly movable in the flow tube relative to the shuttle in response to well fluid flowing upward from the pump while the pump is operating, causing the spring to move the shuttle to the closed position;

an upward facing shoulder at a lower end of the bore;

a thermoplastic bushing abutting the upward facing shoulder and adhered within the bore by a layer of adhesive; wherein the shuttle comprises:

a tubular member having an exterior upper cylindrical portion and an exterior lower cylindrical portion of smaller outer diameter than the upper cylindrical portion and separated from the upper cylindrical portion by a downward facing shoulder;

annular upper and lower seals surrounding the lower cylindrical portion;

an upper spacer ring surrounding the lower cylindrical portion below the upper seal and a lower spacer ring surrounding the lower cylindrical portion above the lower seal, the upper and lower spacer rings being axially movable a limited extent relative to the lower cylindrical portion and relative to each other;

a stop ring in engagement with a groove on the lower cylindrical portion below the upper spacer ring and above the lower spacer ring; wherein downward movement of the upper spacer ring on the lower cylindrical portion is limited by contact with the stop ring; and upward movement of the lower spacer ring on the lower cylindrical portion is limited by contact with the stop ring.

17. The apparatus according to claim 16, wherein:

the flow tube has a length greater than 10 feet.

18. The apparatus according to claim 16, wherein the flow tube has a length at least 25 times an outer diameter of the valve housing.

19. The apparatus according to claim 16, further comprising:

a snap ring groove in the bore at an upper end of the bushing; and a snap ring in engagement with the snap ring groove and overlying the upper end of the bushing.

20. The apparatus according to claim 16, further comprising:

a threaded ring secured by threads to an exterior threaded section on the shuttle below the lower cylindrical portion and the lower seal that releasably retains the lower seal and the lower spacer ring on the lower cylindrical portion.

* * * * *